United States Patent [19]

Woodfalks

[11] Patent Number: 4,891,797

[45] Date of Patent: Jan. 2, 1990

[54] RUNNING SHOE WITH INTEGRAL TIMER

[76] Inventor: Joselean Woodfalks, 15811 Ridgebrook Path, Romulus, Mich. 48174

[21] Appl. No.: 329,964

[22] Filed: Mar. 29, 1989

[51] Int. Cl.[4] ..... G04B 47/00; A43B 5/00

[52] U.S. Cl. ..... 368/10; 368/110; 36/132

[58] Field of Search ..... 368/10, 107-113, 368/276, 278, 327; 36/114, 136; D2/264, 265, 305, 310, 314

[56] References Cited

U.S. PATENT DOCUMENTS

| | | | |
|---|---|---|---|
| 4,337,529 | 6/1982 | Morokawa | 368/109 |
| 4,402,147 | 9/1983 | Wu | 36/136 |
| 4,466,204 | 8/1984 | Wu | 36/136 |
| 4,510,704 | 4/1985 | Johnson | 36/136 |
| 4,526,473 | 7/1985 | Zahn | 368/10 |
| 4,651,446 | 3/1987 | Yukawa et al. | 36/132 |
| 4,652,141 | 3/1987 | Arai | 368/278 |
| 4,674,743 | 6/1987 | Hirano | 272/100 |
| 4,741,001 | 4/1988 | Ma | 377/24.2 |
| 4,771,394 | 9/1988 | Cavanagh | 36/136 |

FOREIGN PATENT DOCUMENTS

| | | | |
|---|---|---|---|
| 1119663 | 7/1968 | United Kingdom | 36/136 |
| 2121219 | 12/1983 | United Kingdom | 36/136 |

*Primary Examiner*—Vit W. Miska

*Attorney, Agent, or Firm*—Jerry T. Kearns

[57] ABSTRACT

A running shoe with an integral timer includes a shoe having an upper body portion and a lower sole portion divided into a toe portion and a rearward heel portion separated by a recessed arch portion. An electronic digital stop watch is embedded in the material utilized to form the recessed arch portion and a flexible cover is removably secured to cover a display and function control buttons provided on side wall portions of the central arch. A step counter may be mounted in the arch and includes an actuating switch embedded in the sole portion of the shoe for counting steps of an individual. Start/stop and reset buttons for the stop watch may be provided on heel and toe portions of the shoe, enabling an individual to actuate the stop watch by kicking the heel or toe of the shoe against an object.

14 Claims, 4 Drawing Sheets

RUNNING SHOE WITH INTEGRAL TIMER

BACKGROUND OF THE INVENTION

1. Field of the Invention

The present invention relates to sports timing devices and more particularly pertains to a running shoe including an integral timer and step counter. The sport of running and also walking is becoming increasingly popular for reasons of health and fitness. Individuals involved in these sports frequently wish to maintain a record of their training sessions in order to be able to accurately monitor their progress. Conventionally, these individuals are required to wear or carry a stop watch in order to achieve this result. However, the wearing or carrying of a timing device can interfere with the runner's natural movement and can also distract the runner from the training session. In order to overcome these problems, the present invention provides a running shoe including an integral stop watch and step counter which are embedded in a recessed arch portion of the shoe.

2. Description of the Prior Art

Various types of sports timing devices are known in the prior art. A typical example of such a timing device with integral timer is to be found in U.S. Pat. No. 4,337,529, which issued to S. Morokawa on June 29, 1982. This patent discloses a pace timing device for timing steps or other actions during physical exercise and for providing audible tone bursts as timing information. U.S. Pat. No. 4,526,473, which issued to N. Zahn on July 2, 1985 discloses a sports timer having an electronic time display mounted on a pair of goggles. The device provides a heads up electronic time display which enables athletes to monitor their performance during training exercises. U.S. Pat. No. 4,652,141, which issued to M. Arai on Mar. 24, 1987, discloses a timing apparatus integrally formed with a glove which enables motorcycle riders, marathon athletes, skiers and other individuals to see or check time by one handed actuation of fingertip mounted control buttons. U.S. Pat. No. 4,674,743, which issued to M. Hirano on June 23, 1987, discloses an athletic training unit including a radio receiver and speakers for transmitting music and instructor's messages to an exerciser in a wireless manner. A desired rhythm signal is selectively supplied to the speakers from a rhythm generator so as to provide the musical rhythm to the exercisers. The device further has a sensor for detecting the pulse of the exerciser and an alarm which indicates when the pulse exceeds a safe upper limit. U.S. Pat. No. 4,741,001, which issued to R. Ma on Apr. 26, 1988, discloses a pedometer stop watch which includes a mechanical swing device and a group of electronic circuits disposed in a small sized housing. The swing device features a highly balanceable and sophisticated pendulum designed to absorb the natural swing energy of a human body during running. While the pendulum is swinging, a micro-switch will turn on or off to transmit every signal to an IC where the precise number of running steps is calculated.

While the above mentioned devices are suited for their intended usage, none of these devices disclose the provision of a stop watch and a pedometer in a recessed arch portion of a running shoe. Inasmuch as the art is relatively crowded with respect to these various types of timing devices, it can be appreciated that there is a continuing need for and interest in improvements to such timing devices, and in this respect, the present invention addresses this need and interest.

SUMMARY OF THE INVENTION

In view of the foregoing disadvantages inherent in the known types of timing devices now present in the prior art, the present invention provides an improved running shoe with an integral timer. As such, the general purpose of the present invention, which will be described subsequently in greater detail, is to provide a new and improved running shoe with an integral timer which has all the advantages of the prior art timing devices and none of the disadvantages.

To attain this, representative embodiments of the concepts of the present invention are illustrated in the drawings and make use of a running shoe with an integral timer which includes a shoe having an upper body portion and a lower sole portion divided into a toe portion and a rearward heel portion separated by a recessed arch portion. An electronic digital stop watch is embedded in the material utilized to form the recessed arch portion and a flexible cover is removably secured to cover display and function control buttons provided on side wall portions of the central arch. A step counter may be mounted in the arch and includes an actuating switch embedded in the sole portion of the shoe for counting steps of an individual. Start/Stop and reset buttons for the stop watch may be provided on heel and toe portions of the shoe, enabling an individual to actuate the stop watch by kicking the heel or toe of the shoe against an object.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way It is therefore an object of the present invention to provide a new and improved running shoe with an integral timer which has all the advantages of the prior art timing devices and none of the disadvantages.

It is another object of the present invention to provide a new and improved running shoe with an integral timer which may be easily and efficiently manufactured and marketed.

It is a further object of the present invention to provide a new and improved running shoe with an integral timer which is of a durable and reliable construction.

An even further object of the present invention is to provide a new and improved running shoe with an integral timer which is susceptible of a low cost of manufacture with regard to both materials and labor, and which accordingly is then susceptible of low prices of sale to the consuming public, thereby making such running shoes economically available to the buying public.

Still yet another object of the present invention is to provide a new and improved running shoe with an integral timer which provides in the apparatuses and methods of the prior art some of the advantages thereof, while simultaneously overcoming some of the disadvantages normally associated therewith.

Still another object of the present invention is to provide a new and improved running shoe with an integral timer enables athletes to monitor their training performance without carrying additional equipment.

Yet another object of the present invention is to provide a new and improved running shoe with an integral timer which includes a pedometer for counting the steps of an individual during training.

Even still another object of the present invention is to provide a new and improved running shoe with an integral timer which utilizes heel and toe mounted start/stop and reset buttons for an integral stop watch for enabling an individual to activate a timing device by merely kicking an object.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
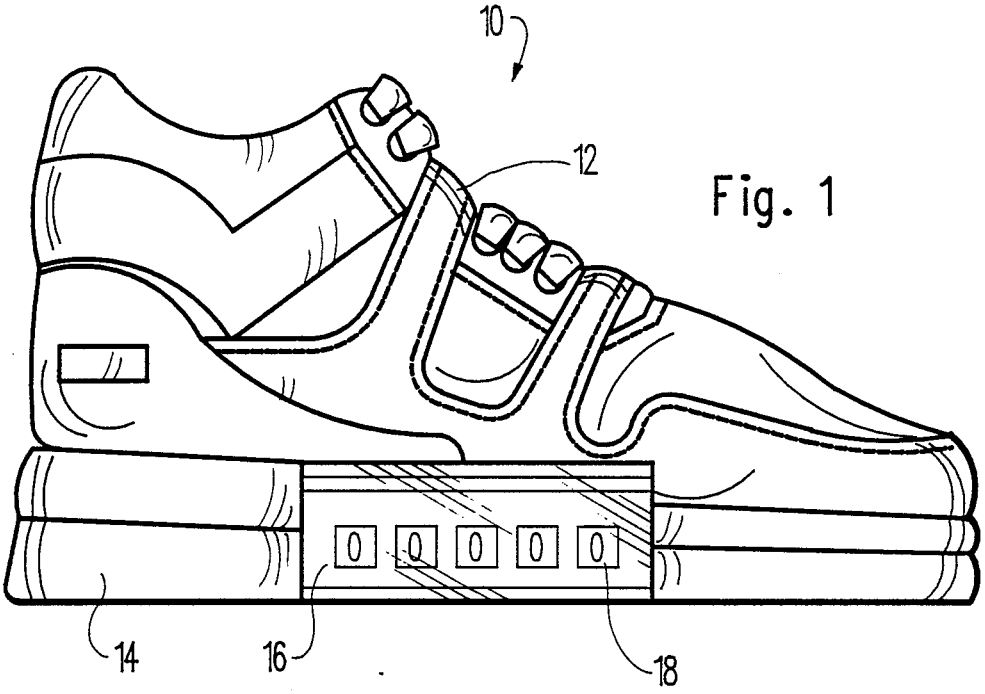
FIG. 1 is a side view of a running shoe according to a first embodiment of the present invention.

With reference now to the drawings, and in particular to FIG. 1 thereof, a new and improved running shoe with an integral timer embodying the principles and concepts of the present invention and generally designated by the reference numeral 10 will be described.

More specifically, it will be noted that the first embodiment 10 of the invention includes a generally conventional running shoe having an upper body portion 12 and a sole portion 14. The sole portion 14 includes a forward toe portion and a rearward heel portion separated by a central recessed arch. The sole portion 14 of the shoe is preferably formed from a sYnthetic flexible material by a conventional molding process. The recessed central portion of the sole is provided with an integral embedded electronic digital timer, such as for example a stop watch. A pedometer may additionally be disposed in the recessed arch portion of the sole 14 during the manufacturing process. The electronic components of the stop watch and the pedometer are conventional and reference may be had to the disclosures of U.S. Pat. No. 4,741,001, the disclosure of which is hereby incorporated by reference and U.S. Pat. No. 4,337,529, also incorporated herein by reference, for the constructional details of the conventional electronic components. The present invention is not directed towards these conventional electronics, but toward the provision of a running shoe with integral electronic timing and step counting mechanisms. The encapsulated pedometer includes a counter display 18 which may take the form of a conventional LCD digital display A cover 16 is preferably formed from a flexible plastic material and has opposite parallel side wall portions connected by a transverse bottom wall.

Figure 2:
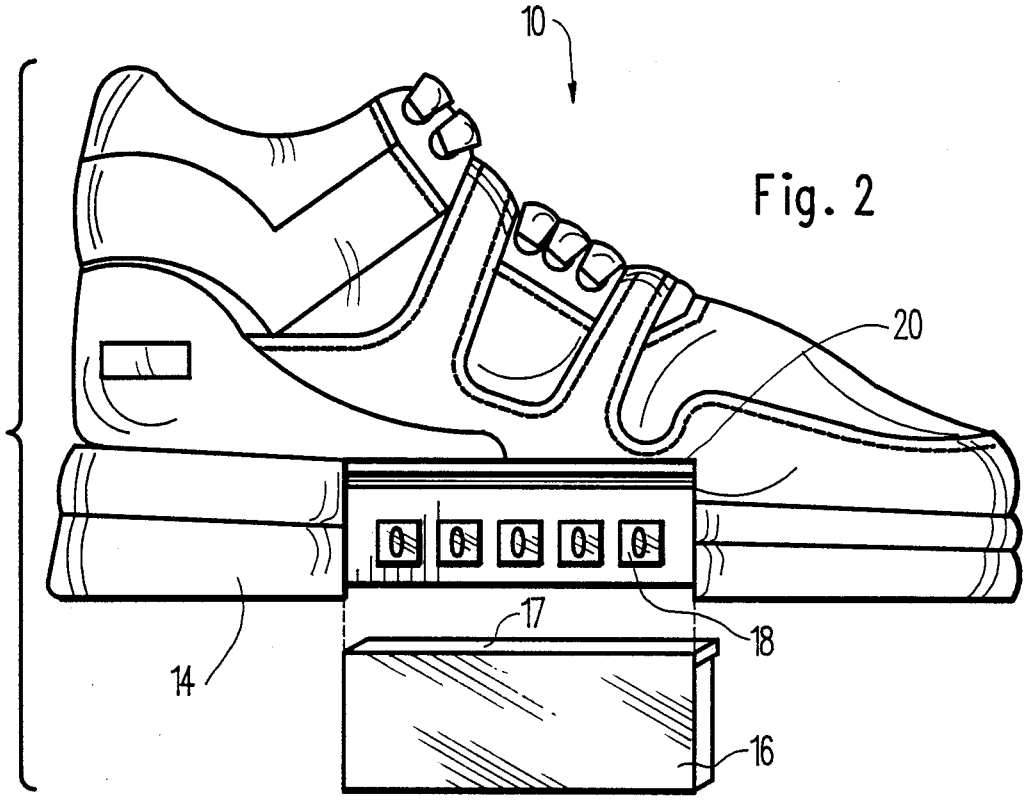
FIG. 2 is an exploded side view which illustrates the running shoe with the stop watch cover removed.

As illustrated in FIG. 2, the cover 16 has a projecting rib 17 which extends inwardly at a top edge of each of the opposed parallel side walls. The cover 16 and projecting rib 17 are dimensioned for snap type engagement within a recessed groove 20 formed in the side wall of the recessed arch portion of the sole 14. Thus, the cover 16 may be snapped unto or off of the central arch and enclosed stop watch and pedometer units.

Figure 3:
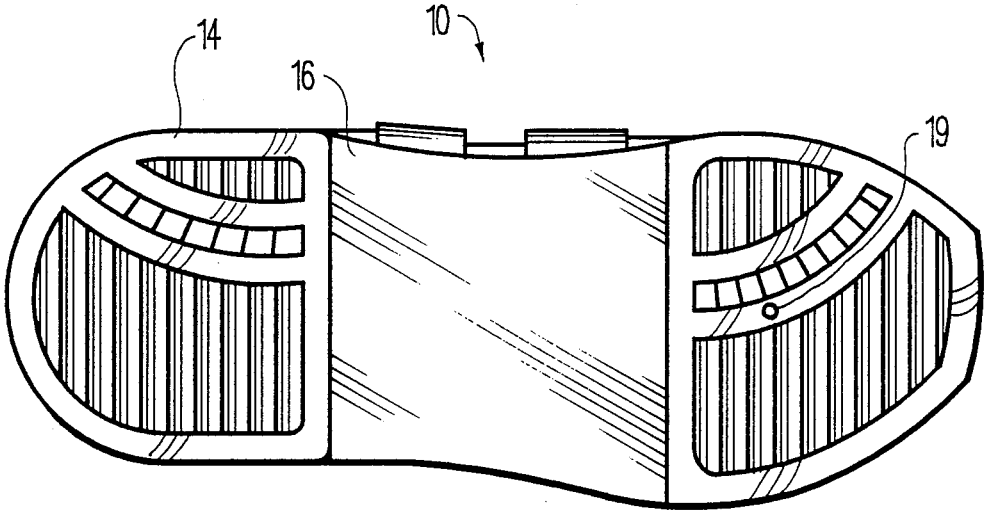
FIG. 3 is a bottom plan view of the sole of the running shoe according to the first embodiment of the present invention.

FIG. 3 illustrates a bottom plan view of the shoe 10, with the cover 16 in place over the central recessed arch portion of the sole 14. A switch 19 is disposed centrally on the forward toe portion of the sole 14 and is connected for incrementally actuating the counter display 18 (FIG. 1) of the pedometer. The switch 19 may be exposed through the sole 14 or, preferably is encapsulated therein. The switch 19 is a micro-switch which may be conventionally formed in the manner of blister type small travel switches conventionally utilized on the control panels of microwave ovens, calculators, and other conventional electronic devices. The micro-switch 19 may take a variety of conventional forms, without departing from the scope of the present invention. Additionally, the switch 19 may be disposed at various other locations on the sole 14, for example on the rearward heel portion.

Figure 4:
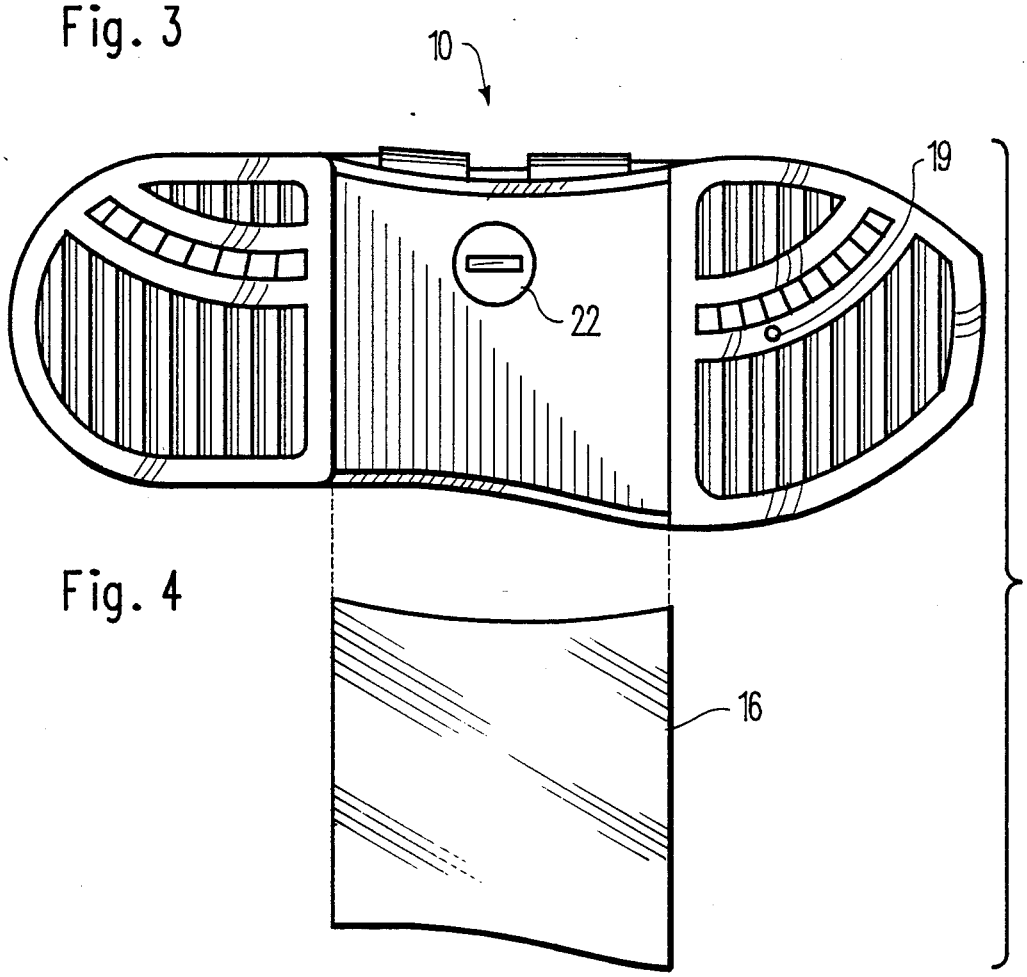
FIG. 4 is an exploded plan view which illustrates the running shoe of FIG. 3 with the stop watch cover removed.

FIG. 4 illustrates a similar bottom plan view of the shoe 10, with the cover 16 removed therefrom. A removable threaded plug 22 may be disposed on the bottom surface of the recessed central heel portion for installation of batteries for powering the stop watch and pedometer units. Alternatively, an enclosed lithium type battery may be encapsulated within the molded sole portion. Such long life lithium batteries have a service life longer than the average life span of a pair of running shoes.

Figure 5:
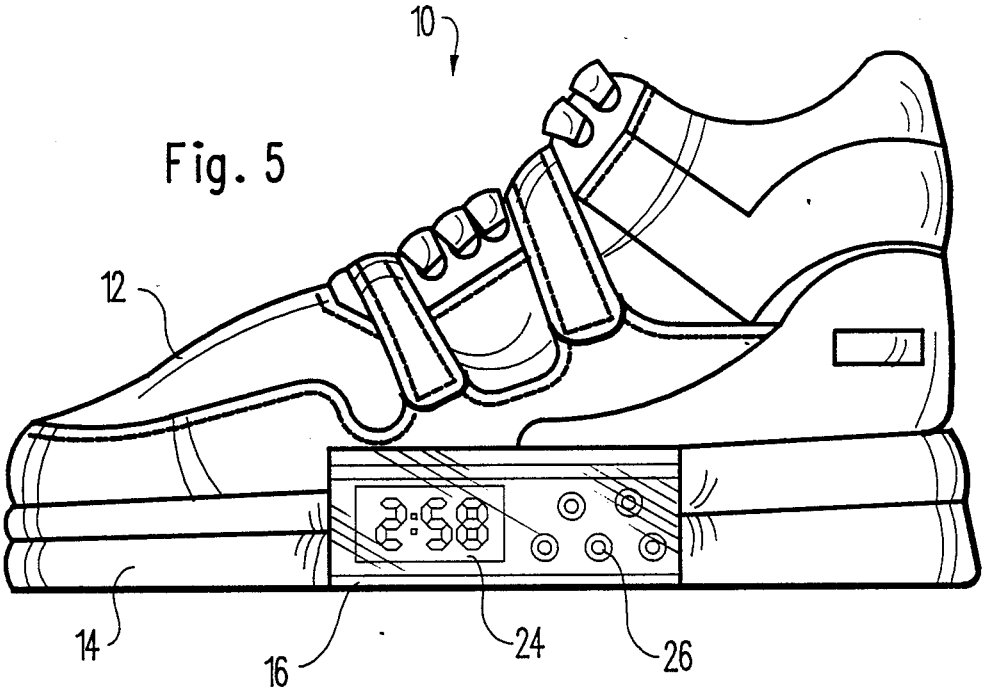
FIG. 5 is an opposite side view of the running shoe according to the first embodiment of the present invention, illustrating the stop watch and stop watch function control buttons.

FIG. 5 illustrates a side view of the shoe 10, opposite the side illustrated in FIG. 1. A display 24 for the stop watch unit is preferably formed in the illustrated opposite side wall of the central recessed arch portion and a plurality of functions buttons 26 may also be located thereon. The cover 16 protects the stop watch display 24 and the function buttons 26.

Figure 6:
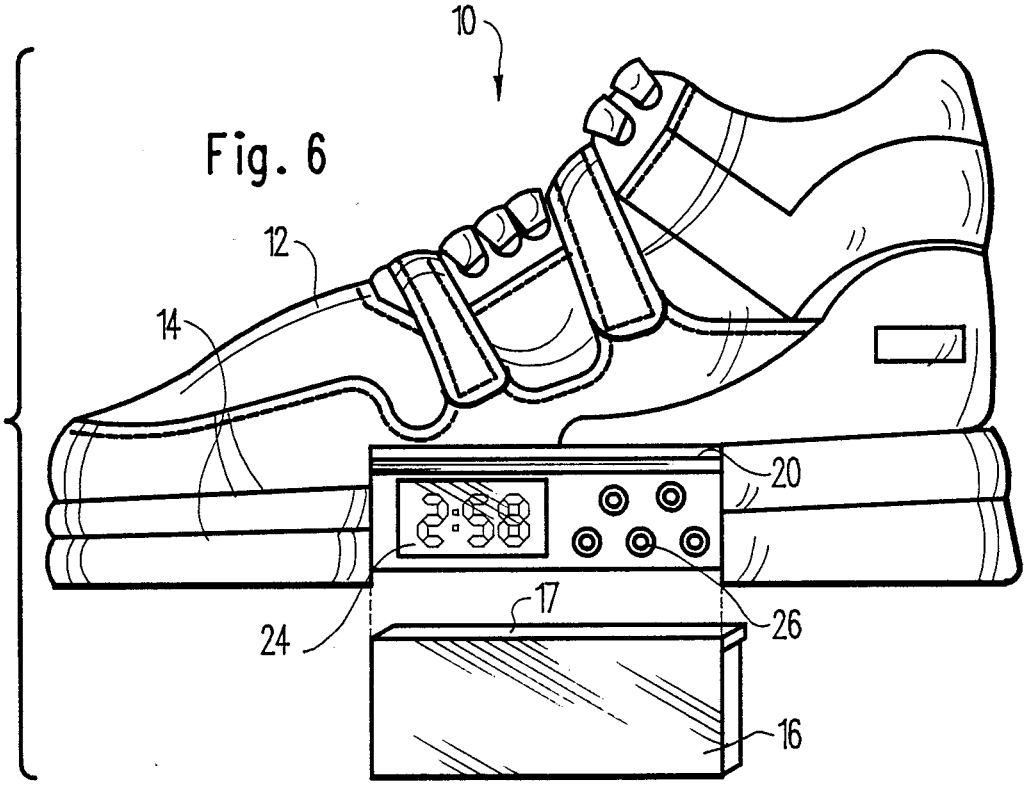
FIG. 6 is a side view, similar to FIG. 5, illustrating the shoe with the stop watch cover removed.

FIG. 6 illustrates the side view of the shoe of FIG. 5, with the cover 16 removed. As previously illustrated in FIG. 2, the opposite side of the cover 16 also includes a projecting rib 17 for snap type engagement with a recessed groove 20 provided in the side wall of the central arch portion. The display 24 of the stop watch is preferably of the conventional LCD type.

Figure 7:
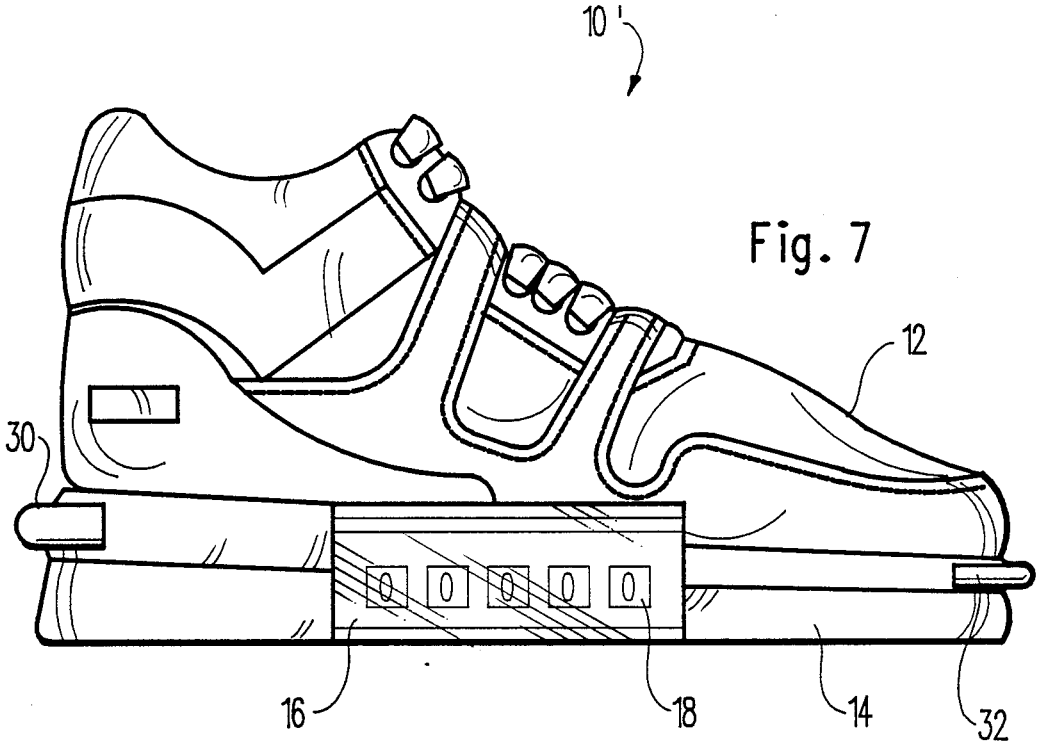
FIG. 7 is a side view illustrating a running shoe according to a second embodiment of the present invention, in which function control buttons for the stop watch are provided on heel and toe portions of the shoe.

FIG. 7 illustrates a side view, similar to FIG. 1, of a stop watch 10' according to a slightly modified second embodiment of the present invention. In this embodiment, a micro-switch start/stop button is encapsulated within a resilient toe bumper 32 secured at the front of the sole portion 14. A similar micro-switch lap reset button 30 is disposed on the sole portion 14 at the heel of the shoe. Electrical connections from the toe switch 32 and heel switch 30 are encapsulated within the sole 14 during the molding process and are connected with the stop watch unit located in the central arch portion of the shoe. Thus, an individual may control the stop watch functions merelY by kicking the toe or heel of the shoe against an object such as a curb, the surface of a side walk, a sign post, a building, or a variety of other objects. This enables hands free operation of the stop watch.

Figure 8:
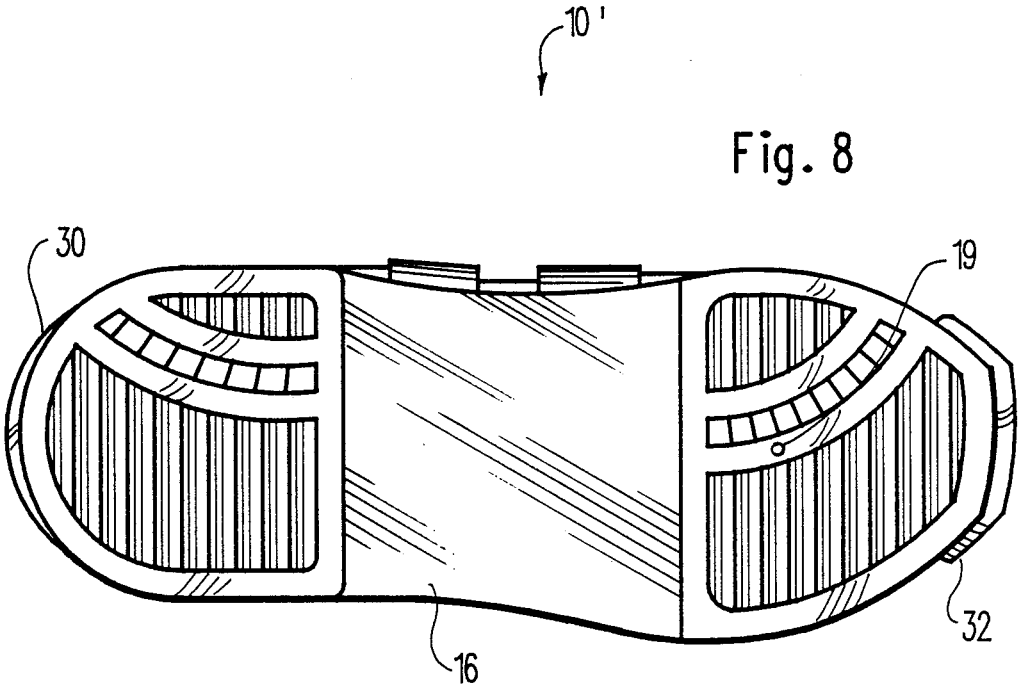
FIG. 8 is a bottom plan view of the shoe of FIG. 7.

FIG. 8 illustrates a bottom plan view of the shoe 10' according to the second embodiment of the present invention.

As may now be understood, the present invention provides a running shoe with an integral timer unit which enables individuals to measure not only the time of their training session, but also the distance traveled. The distance traveled may be computed by an individual by multiplying their average stride distance with the number of steps displayed on the counter 18. The stop watch timer and pedometer may be inexpensively formed in a conventional fashion on a single integrated circuit chip encapsulated in the central arch of the shoe. It should be noted that this mounting technique provides adequate protection against shock and does not greatly add to the manufacturing cost of a conventional running shoe.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the U.S. is as follows:

1. A running shoe with an integral timer, comprising:
said shoe having an upper body portion and a lower sole portion;
said sole portion having a forward toe portion and a rearward heel portion separated by a recessed central arch portion;
timing means in said recessed arch portion;
a removable flexible cover for covering said recessed arch portion and said timing means, said cover having parallel side wall portions connected by a transverse bottom portion;
a pair of projecting ribs extending inwardly along a top edge of each of said side wall portions; and
cooperating recesses formed on opposite side wall portions of said central recessed arch portion for securing said cover on said timing means.

2. The running shoe with integral timer of claim 1, further comprising counting means in said recessed arch portion for counting steps of an individual.

3. The running shoe with integral timer of claim 2, further comprising switch means in said sole portion for activating said counting means.

4. The running shoe with integral timer of claim 1, wherein said timing means comprises a stop watch.

5. The running shoe with integral timer of claim 4, further comprising a digital display for said stop watch formed on a side wall of said recessed arch portion.

6. The running shoe with integral timer of claim 4, further comprising control buttons for said stop watch on a side wall of said arch portion.

7. A running shoe with an integral timer, comprising:
said shoe having an upper body portion and a lower sole portion;
said sole portion having a forward toe portion and a rearward heel portion separated by a recessed central arch portion;
timing means in said recessed arch portion;
a first control button on a forward side end of a toe portion of said shoe for activating said timing means; and
a second control button on a rearward side end of a heel portion of said shoe for activating said timing means, said first and second control buttons located remotely from said sole portion to prevent activating of said buttons during running and walking, whereby a wearer may control said timing means by selectively kicking an object with said toe and heel portions.

8. The running shoe with integral timer of claim 7, further comprising a removable flexible cover for covering said recessed arch portion and said timing means, said cover having parallel side wall portions connected by a transverse bottom portion;

a pair of projecting ribs extending inwardly along a top edge of each of said side wall portions; and cooperating recesses formed on opposite side wall portions of said central recessed arch portion for securing said cover on said timing means.

9. The running shoe with integral timer of claim 7, further comprising counting means in said recessed arch portion for counting steps of an individual.

10. The running shoe with integral timer of claim 9, further comprising switch means in said sole portion for activating said counting means.

11. The running shoe with integral timer of claim 7, wherein said timing means comprising a stop watch.

12. The running shoe with integral timer of claim 11, further comprising a digital display for said stop watch formed on a side wall of said recessed arch portion.

13. The running shoe with integral timer of claim 11, further comprising control buttons for said stop watch on a side wall of said arch portion.

14. A running shoe with an integral timer, comprising:

said shoe having an upper body portion and a lower sole portion;

said sole portion having a forward toe portion and a rearward heel portion separated by a recessed central arch portion;

counting means in said recessed arch portion for counting steps of an individual;

switch means in said sole portion for activating said counting means;

timing means in said recessed arch portion;

a digital display for said timing means formed on a side wall of said recessed arch portion;

a removable flexible cover for covering said recessed arch portion and said timing means, said cover having parallel side wall portions connected by a transverse bottom portion;

a pair of projecting ribs extending inwardly along a top edge of each of said side wall portions;

cooperating recesses formed on opposite side wall portions of said central recessed arch portion for securing said cover on said timing means;

a first control button on a forward side end of a toe portion of said shoe for activating said timing means; and a second control button on a rearward side end of a heel portion of said shoe for activating said timing means, said first and second control buttons located remotely from said sole portion to prevent activation of said buttons during running and walking, whereby a wearer may control said timing means by selectively kicking an object with said toe and heel portions.

* * * * *